US012790104B2

(12) United States Patent
Perry

(10) Patent No.: US 12,790,104 B2
(45) Date of Patent: Nov. 10, 2026

(54) FOLDABLE DISC PACKAGING

(71) Applicant: Nathan Perry, Denver, CO (US)

(72) Inventor: Nathan Perry, Denver, CO (US)

( * ) Notice: Subject to any disclaimer, the term of this patent is extended or adjusted under 35 U.S.C. 154(b) by 0 days.

(21) Appl. No.: 19/321,437

(22) Filed: Sep. 8, 2025

(65) Prior Publication Data

US 2026/0001704 A1 Jan. 1, 2026

Related U.S. Application Data

(63) Continuation of application No. 18/393,463, filed on Dec. 21, 2023, now abandoned.

(51) Int. Cl.

| | |
|---|---|
| ***B65D 85/00*** | (2006.01) |
| ***B65D 5/20*** | (2006.01) |
| ***B65D 75/02*** | (2006.01) |

(52) U.S. Cl.

CPC ..... *B65D 85/54* (2013.01); *B65D 5/2028* (2013.01); *B65D 75/02* (2013.01); *B65D 2585/54* (2013.01)

(58) Field of Classification Search

CPC .... B65D 85/54; B65D 85/544; B65D 5/2028; B65D 75/02; B65D 2585/54; B65D 5/2033; B65D 5/20

USPC ..... 206/449, 8, 312; 232/64, 55, 1 D; 229/68.1, 87.2, 87.19

See application file for complete search history.

(56) References Cited

U.S. PATENT DOCUMENTS

| | | | | |
|---|---|---|---|---|
| 3,561,671 A * | 2/1971 | Minot, Jr. | B65D 85/546 206/312 |
| 4,607,785 A * | 8/1986 | Croley | B65D 5/2033 229/110 |
| 6,016,908 A * | 1/2000 | Gaetano | G11B 33/0427 |
| 6,053,399 A * | 4/2000 | Wurdeman | B65D 27/28 229/116.2 |
| 7,578,389 B1 * | 8/2009 | Haas | G11B 33/0422 229/92.8 |
| 2006/0208052 A1 * | 9/2006 | Cousins | B65D 5/2028 229/187 |
| 2019/0077538 A1 * | 3/2019 | Wang | B65D 5/246 |

FOREIGN PATENT DOCUMENTS

| | | | |
|---|---|---|---|
| WO | WO-9709237 A1 * | 3/1997 | B65D 5/008 |
| WO | WO-9800815 A1 * | 1/1998 | G07D 7/026 |

* cited by examiner

*Primary Examiner* — Rafael A Ortiz

(74) *Attorney, Agent, or Firm* — Polsinelli PC; Derek Donahoe

(57) ABSTRACT

Aspects of the present disclosure involve packaging and methods of producing a package for a circular disc. In a first embodiment, the flat, semi-rigid, circular material may be folded to encase the storage disc. One or more flaps of the circular packaging may be folded to encase the storage disc within the packaging. In another embodiment, the foldable flaps of the circular packaging may create a hexagon base to provide six points of contact with the encased storage disc to retain the disc securely within the packaging. The packaging may be constructed from such materials as cardboard, paper, semi-rigid plastic, or the like. In some implementations, the packaging material may be rigid and include one or more hinges to allow the flaps to fold over the storage disc to protect a storage disc through packaging of various shapes.

15 Claims, 8 Drawing Sheets

FOLDABLE DISC PACKAGING

CROSS-REFERENCE TO RELATED APPLICATION

This application is a continuation of U.S. patent application Ser. No. 18/393,463 filed Dec. 21, 2023, titled "Foldable Disc Packaging," the entire contents of which is incorporated herein by reference for all purposes.

TECHNICAL FIELD

Various embodiments described herein relate to the field of packaging and the corresponding methods of making and using the same.

BACKGROUND AND INTRODUCTION

Packaging is key to ensure the safekeeping of physical information storage, such as compact discs (CDs) and other flat, circular media. However, advancements in conventional packaging for CDs, records, and other circular-shaped media have stagnated as the world has moved toward purely digital forms of information storage. Traditional packaging for CDs includes clamshell cases, jewel cases and digipaks. Specifically, clamshell and/or jewel cases have plastic sides that hinge along a joined side and open in either a vertical or horizontal direction to reveal the enclosed circular-shaped media. Similar to clamshell and jewel cases, digipaks also hinge along a joined side but are made of cardboard sides that contain an internal plastic holder for the circular-shaped media.

These conventional packaging methods present many limitations and thus a clear need for improvement. One limitation is the multiple materials needed, including cardboard, plastic, and/or the various adhesives (such as glue) to hold the materials in shape, needed to manufacture a single packaging enclosure. Not only do these materials increase production costs, but they also lengthen the manufacturing process. Further, if the packaging is damaged, increased vulnerability of the circular-shaped media may be present. In one specific example, the hinge of a clamshell/jewel case or digipak can be easily broken if closed the wrong way and/or dropped such that the packaging becomes less secure. With such damage, the circular-shaped media becomes exposed and prone to scratches, cracks, or other types of damages. Another drawback to traditional packaging is the broad structure and shape of the packaging. Conventional packaging is either a circular or rectangular shape and tends to have a greater width than the enclosed circular-shaped media. This restricts the places that the packaging fits and can be conveniently stored.

It is with these observations in mind, among others, that various aspects of the present disclosure were conceived.

SUMMARY

One aspect of the present disclosure relates to a package for a storage disc comprising a circular disc. The circular disc may include a base and at least three foldable flaps, wherein each of the at least three foldable flaps corresponds to a fold line along a portion of the circular disc, each fold line defining an edge of the base, wherein a first flap of the at least three foldable flaps is folded along a corresponding first fold line over the storage disc, a second flap of the at least three foldable flaps is folded along a second corresponding fold line over the first flap, and a third flap of the at least three foldable flaps is folded along a third corresponding fold line over the second flap.

Another aspect of the present disclosure relates to a method for packaging a storage disc. The method may include the operations of inserting the storage disc into package comprising at least three foldable flaps, folding a first flap along a first fold line to at least partially cover the storage disc, folding a second flap along a second fold line to at least partially cover the first flap, folding a third flap along a third fold line to at least partially cover the second flap, and affixing the third flap to the second flap.

DETAILED DESCRIPTION

Aspects of the present disclosure involve packaging and methods of producing a package for a circular disc. In some embodiments, the packaging may be for a physical information storage disc, such as a compact disc, a record, or other flat, circular media. In a first embodiment, the flat, semi-rigid, circular material may be folded to encase the storage disc. One or more flaps of the circular packaging may be folded to encase the storage disc within the packaging. In one particular implementation, the packaging may include three foldable flaps to create a triangular base in the packaging on which the storage may rest once the flaps are folded over the disc. The triangular base may provide three points of contact with the encased storage disc to retain the disc securely within the packaging. In another embodiment, the foldable flaps of the circular packaging may create a hexagon base to provide six points of contact with the encased storage disc to retain the disc securely within the packaging. The packaging may be constructed from such materials as cardboard, paper, semi-rigid plastic, or the like. In some implementations, the packaging material may be rigid and include one or more hinges to allow the flaps to fold over the storage disc. Further, the fold lines of the packaging may include a notch along the edge of the circuit packaging to allow the flaps to fold inward and nest over one another. In this manner, the storage disc may be protected through packaging of various shapes while reducing the profile size and material costs of traditional packaging.

Figure 1A:
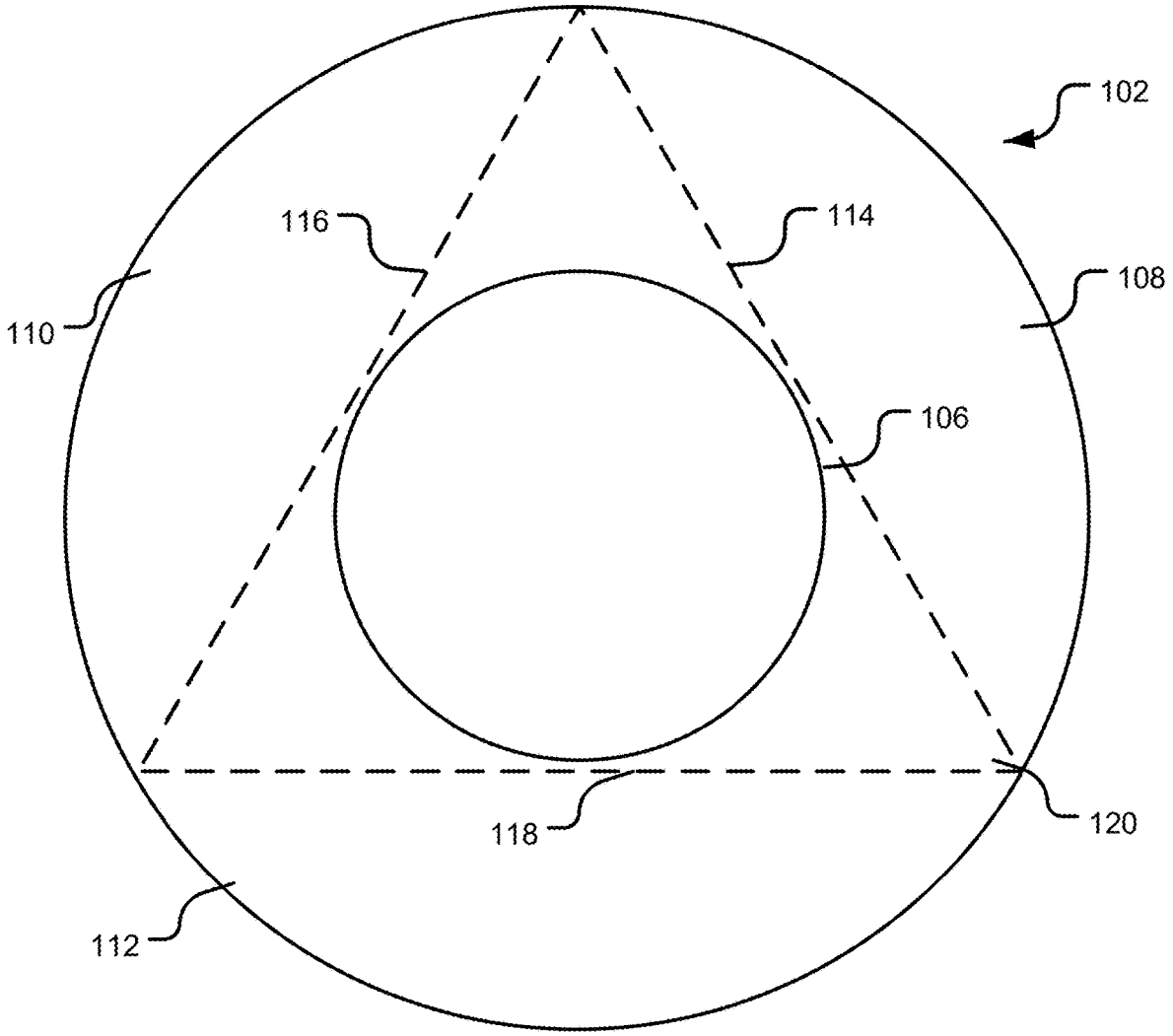
FIG. 1A is an overhead diagram illustrating a first embodiment of a foldable disc package, according to aspects of the present disclosure.
Figure 1B:
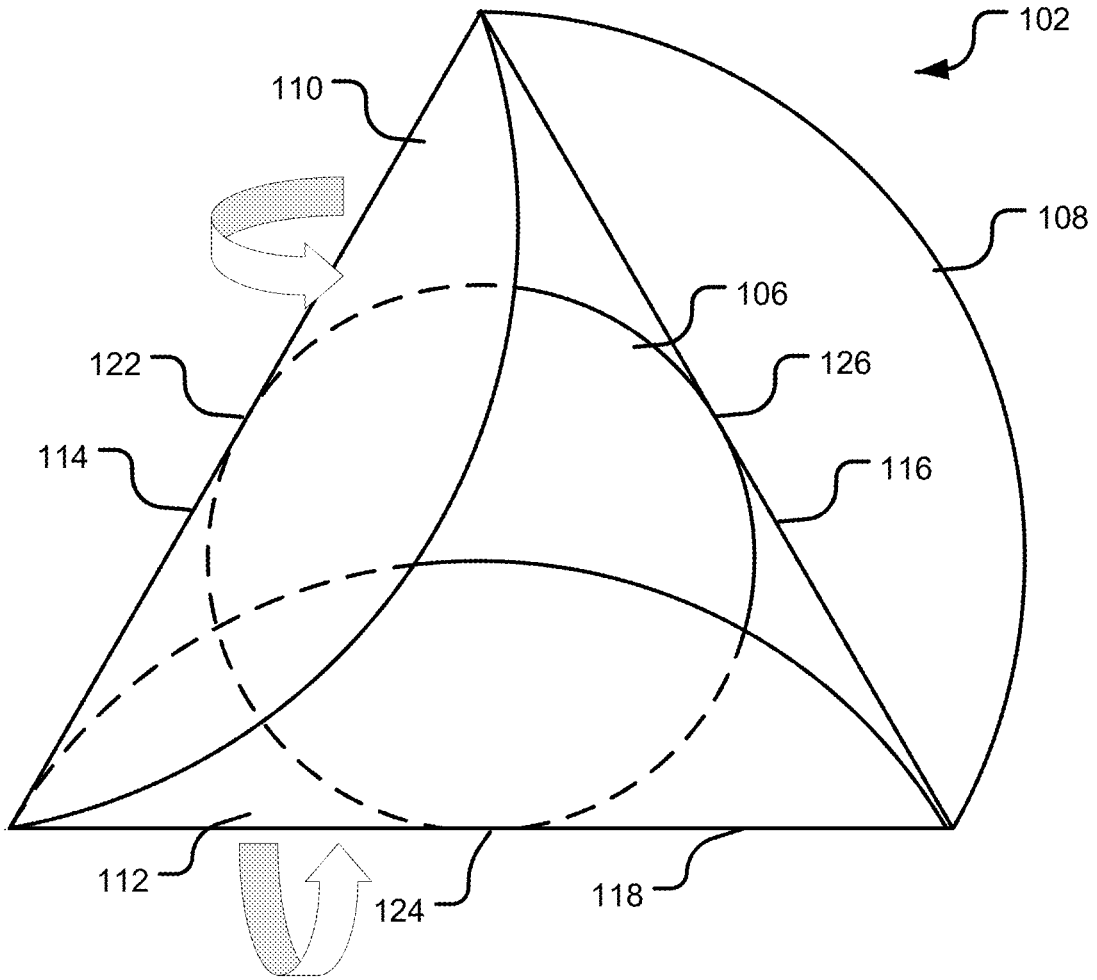
FIG. 1B is an overhead diagram illustrating the first embodiment of the foldable disc package with two of three flaps closed, according to aspects of the present disclosure.

FIG. 1A and FIG. 1B illustrate a first embodiment of a foldable disc package 102, according to aspects of the present disclosure. As described above, the foldable disc package 102 may include a flat, circular disc of a semi-rigid material, such as a cardboard or paper. A storage disc 106, such as a compact disc or record, may be placed in the center of the foldable disc package 102. To enclose the storage disc 106 within the package 102, the package may include a number of flaps, such as flaps 108-112 that may be folded over the storage disc along a corresponding number of fold lines 114-118. For example, a first flap 108 may be folded along fold line 114, a second flap 110 may be folded along a second fold line 116, and a third flap 112 may be folded along a third fold line 118. In the embodiment illustrated in FIG. 1A, the fold lines 114-118 create a triangular base 120 within which the storage disc 106 may be located. Thus, the foldable disc package 102 may have a diameter that is large enough such that the storage disc 106 lies within the triangular base 120 created by the fold lines 114-118.

Figure 1C:
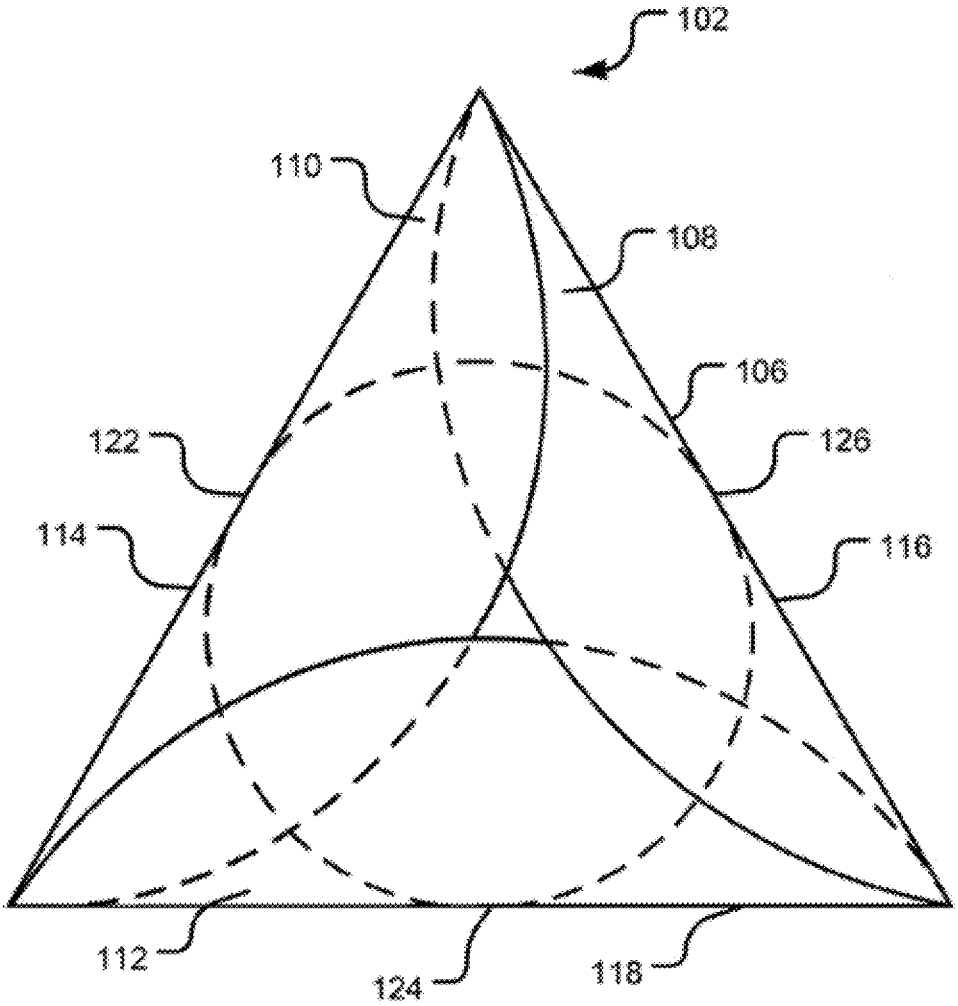
FIG. 1C is an overhead diagram illustrating the first embodiment of the foldable disc package with three flaps closed, according to aspects of the present disclosure.

As best illustrated in FIG. 1B, the storage disc 106 may be encased within the package 102 by folding each of the flaps 108-112 along the fold lines 114-118 inward toward the storage disc 106 to at least partially cover the storage disc by the flaps. Once folded, the flaps 108-112 at least partially cover a portion of the storage disc 106 and/or another of the flaps. For example, third flap 112 may be folded over the storage disc 106 first, followed by the second flap 110 such that the second flap partially overlaps with the third flap. The first flap 108 may be folded last to partially cover the storage disc 106, the second flap 110, and the third flap 112. However, the order in which the flaps 108-112 are folded over the storage disc 106 may vary each time the packaging 102 is closed. In some instances, the flaps 108-112 may be adhered to the base 120 and/or another flap to maintain the flaps closed over the storage disc 106. In another embodiment not illustrated, one or more of the flaps 108-112 may include a tab and another flap or the base 120 may include a corresponding slot. The tab of the flap 108-112 is inserted into the corresponding slot to maintain the flap in position against the storage disc 106. FIG. 1C shows the completed formation of the package 102 wherein flap 108 is folded first, then flap 110 is folded second over flap 108, then flap 112 is folded last over flap 110 and tucked under the first flap 108. This orientation of the flaps 108-112 of the package 102 may keep the flaps in place over the storage disc 106 to retain the disc within the package.

In some instances, the lengths and angles of the fold lines 114-118 may be oriented such that the outer edge of the storage disc 106 touches each fold (when folded, as shown in FIG. 1B) at least at one point. For example, when the third flap 112 is folded along fold line 118, the storage disc 106 may abut against the fold at point 124. Similarly, when the second flap 110 is folded along fold line 114, the storage disc 106 may abut against the fold at point 122 and the fold of the first flap 108 at point 126, when the first flap is folded along fold line 116. Thus, in this configuration, the storage disc 106 may be held in place within the package 102 at least through the three points of contact 122-126 created by the folds of the flaps 108-112 over the storage disc. The three points of contact 122-126, among possible other points of contact, may maintain the storage disc 106 securely within the package 102 on triangular base 120. Once all three flaps 108-112 are folded over the storage disc 106, the package may take on a flat, triangular shape of the base 120 for easy storage and accessibility. Further, the flaps 108-112 and corresponding fold lines 114-118 may be located such that the storage disc 106 is entirely encased within the package 102 by the flaps.

FIGS. 2A-2D illustrate a second embodiment of the of the foldable disc package, according to aspects of the present disclosure. Similar to above, the foldable disc package 202 may include a flat, circular disc of a semi-rigid material, such as a cardboard or paper. A storage disc 206 (illustrated in FIG. 2B), such as a compact disc or record, may be placed in the center of the foldable disc package 202. To enclose the storage disc 206 within the package 202, the package may include a number of flaps that may be folded over the storage disc along a corresponding number of fold lines. However, in this embodiment, the flaps of the package 202 may generate a hexagonal package once folded over the storage disc 206.

As above, the foldable disc package 202 may include a first flap 208, a second flap 210, and a third flap 212. Each of the flaps 208-212 may correspond to a fold line 214-218 to create a triangular base within which the storage disc 206 may be located, as above. However, the embodiment of FIGS. 2A-2E may include additional fold lines to create a hexagonal base in which the storage disc 206 may be placed. In particular, each corner of the triangular base may include a bisecting fold line and a pair of angled fold lines extending from an end of the bisecting fold line to the outer edge of the circular disc package 202. For example, the foldable disc package 202 may include bisecting fold line 220 and angled fold lines 222 and 224. The bisecting fold line 220 extends from first flap 208 to second flap 210 bisecting the triangular base formed by fold lines 214-218 across one corner of the triangular base. Further, angled line 224 may extend from the intersection of the bisecting line 220 and fold line 214 to the outer edge of the circular disc package 202. Similarly, angled line 222 may extend from the intersection of the bisecting line 220 and fold line 216 to the outer edge of the circular disc package 202. A bisecting fold line 226 and angled fold lines 228 and 230 may be similarly located over a second corner of the triangular base and bisecting fold line 232 and angled fold lines 234 and 236 may be similarly located over a third corner of the triangular base. As shown below, the foldable disc package 202 may be folded along these lines to create a hexagonal package for a storage disc 206.

Figure 2A:
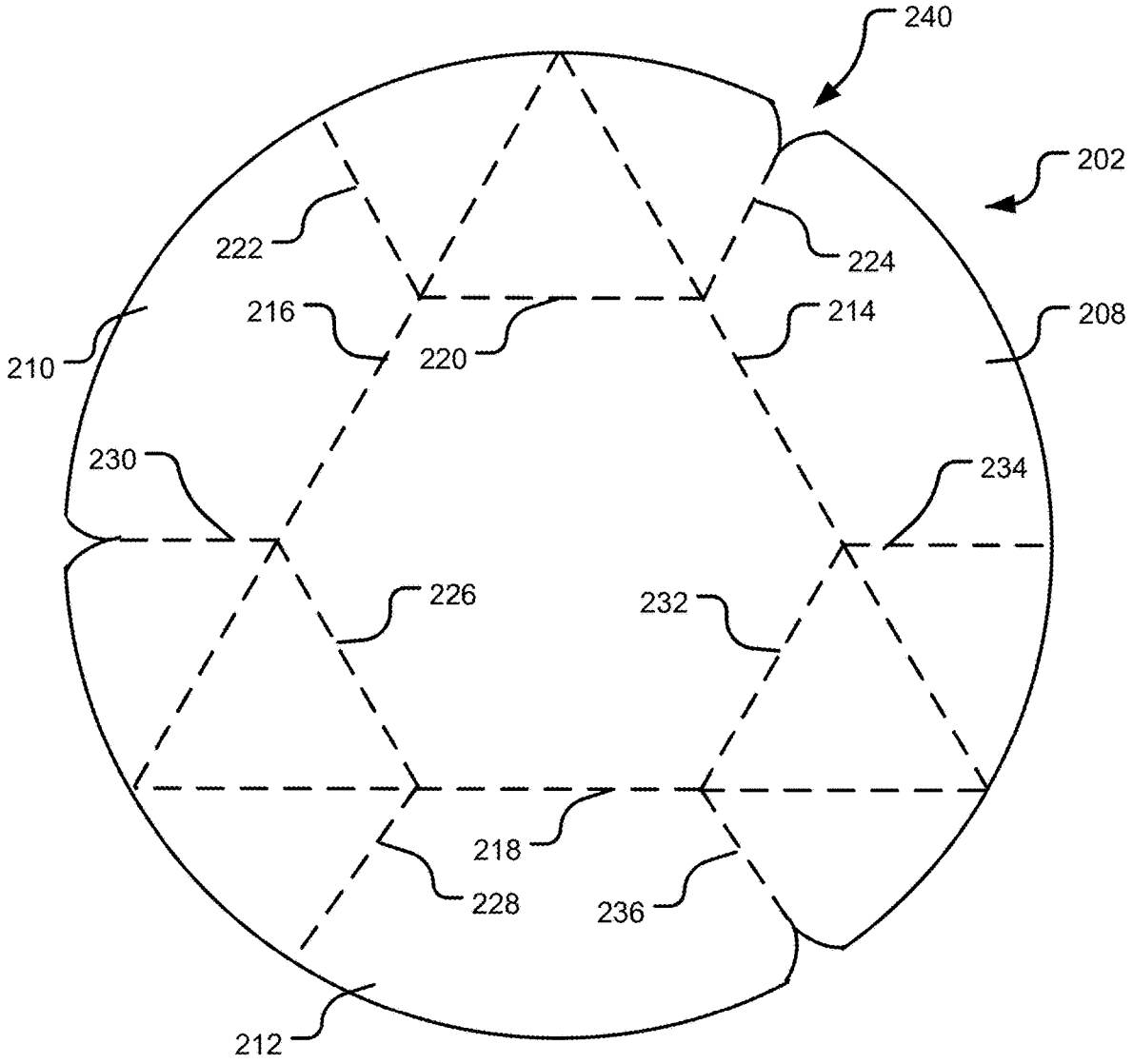
FIG. 2A is an overhead diagram illustrating a second embodiment of a foldable disc package, according to aspects of the present disclosure.
Figure 2B:
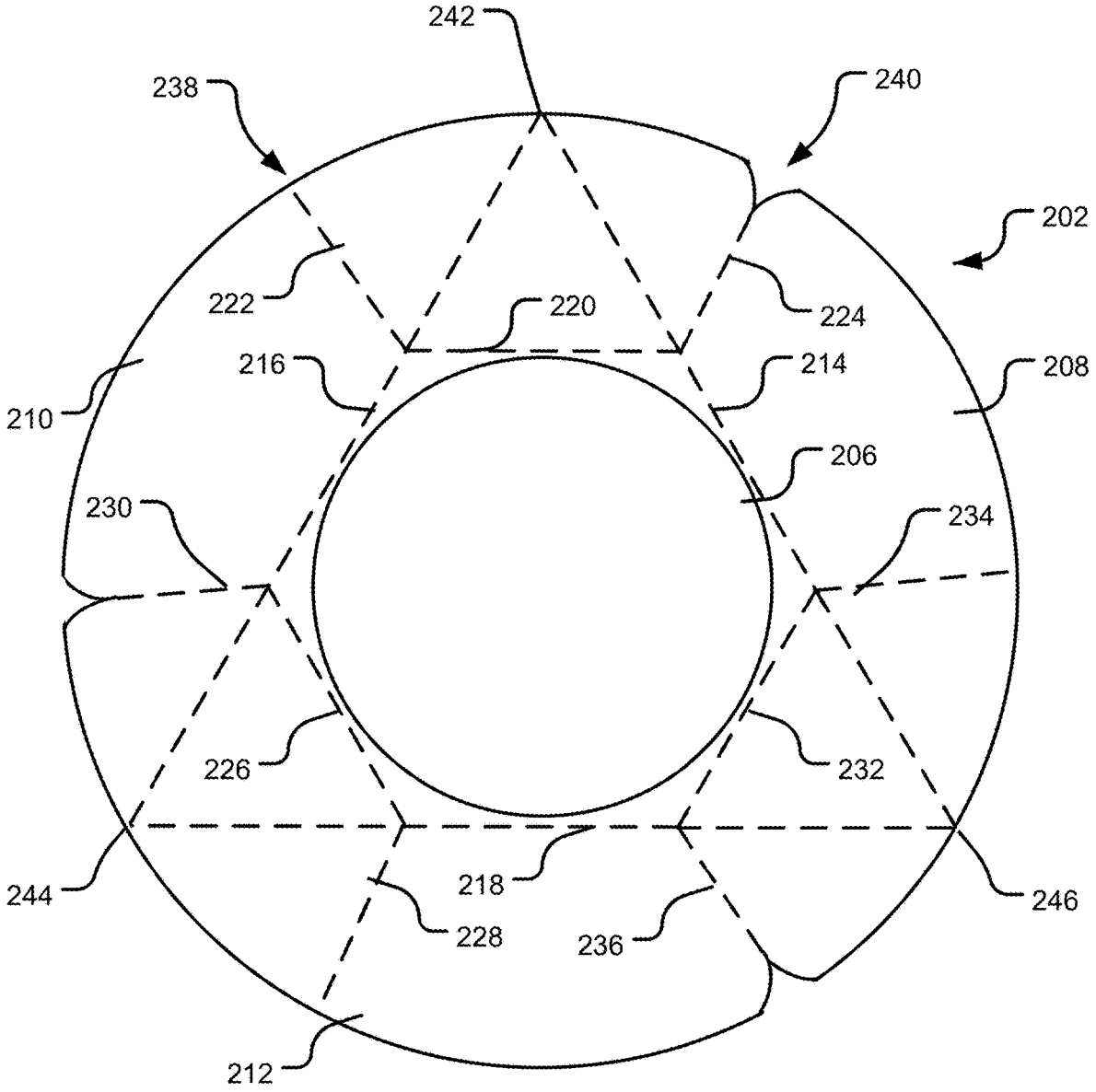
FIG. 2B is an overhead diagram illustrating the second embodiment of a foldable disc package including a circular disc, according to aspects of the present disclosure.
Figure 2C:
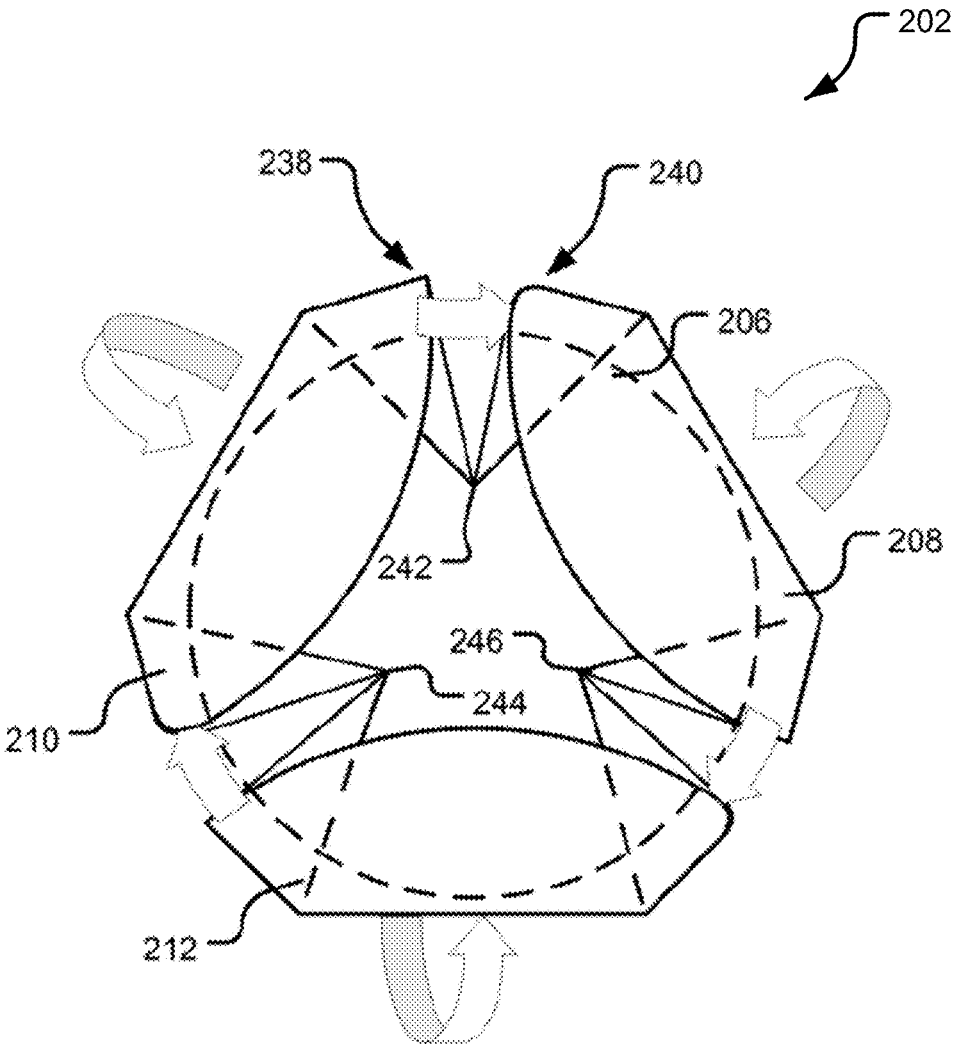
FIG. 2C is an overhead diagram illustrating the second embodiment of a foldable disc package during intermediate closing of the package, according to aspects of the present disclosure.

FIG. 2B illustrates the second embodiment of the foldable disc package 202 of FIG. 2A with the storage disc 206 located within the hexagonal base of the package. In particular, the hexagonal base of the package is created by fold line 220, fold line 214, fold line 232, fold line 218, fold line 226, and fold line 216 that form the six sides of the hexagonal base. The length and angles of the fold lines of the hexagonal base may allow the storage disc 206 to lie within the sides or edges of the hexagonal base. To encase the storage disc 206 within the packages, the flaps 208-212 of the package 202 may be folded inward toward the storage disc. As best shown in FIG. 2C, flaps 208-212 are folded inward over the storage disc 206. More particularly and to create the hexagonal shape of the packaging, corners 242-246 may be first folded inward over the storage disc 206. Each of corner 242-246 is the intersection between the flaps 208-212 of the circular packaging 202, such that corner 242 is the point on the edge of the circular package 202 between the first flap 208 and the second flap 210, corner 244 is the point on the edge of the circular package between the second flap and the third flap 212, and corner 246 is the point on the edge of the circular package between the third flap 210 and the first flap. As shown in FIG. 2C, these corners 242-246 may be pressed inward over the storage disc 206. As the corners 242-246 are pressed inward about the corresponding bisecting fold line, the corresponding angled lines are folded to pull the adjacent flap toward the center of the circular packaging 202. For example, bisecting fold line 220 may fold to allow point 242 to fold inward. As the point 242 is moved toward the center of the circular packaging 202, angled fold lines 222 and 224 are also folded, pulling first flap 208 and second flap 210 also toward the center of the packaging (as seen in FIG. 2C). Each of the three points 242-246 may be pressed inward simultaneously to pull each of the flaps 208-212 over the storage disc 206 to create an enclosed package for the disc.

Figure 2D:
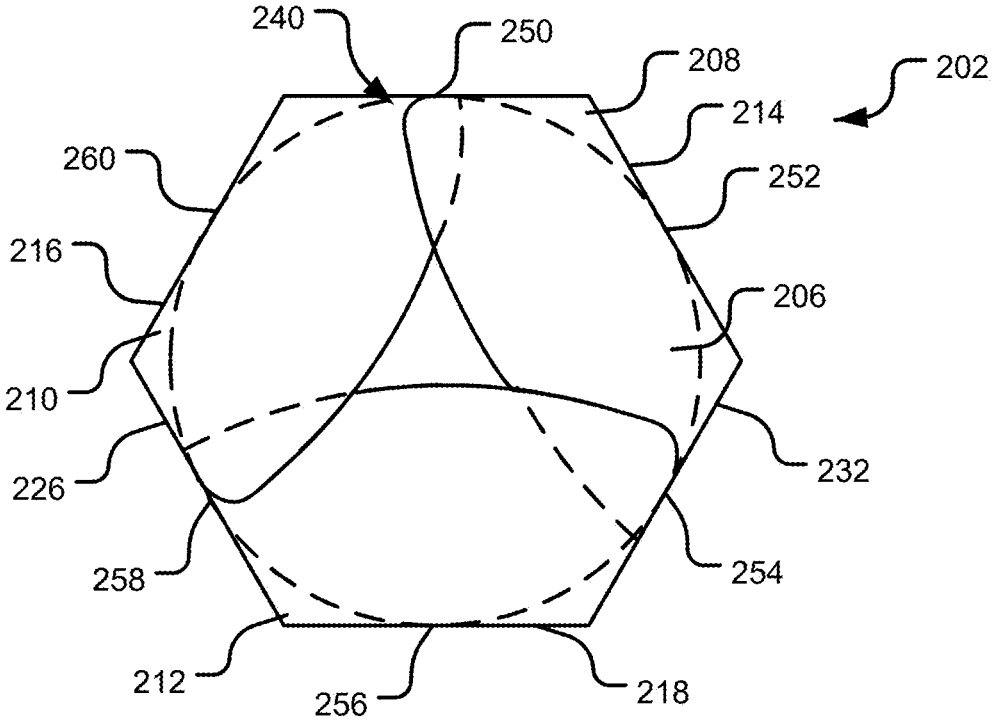
FIGS. 2D and 2E are overhead diagrams illustrating the second embodiment of a foldable disc package enclosed on a circular disc, according to aspects of the present disclosure.
Figure 2E:
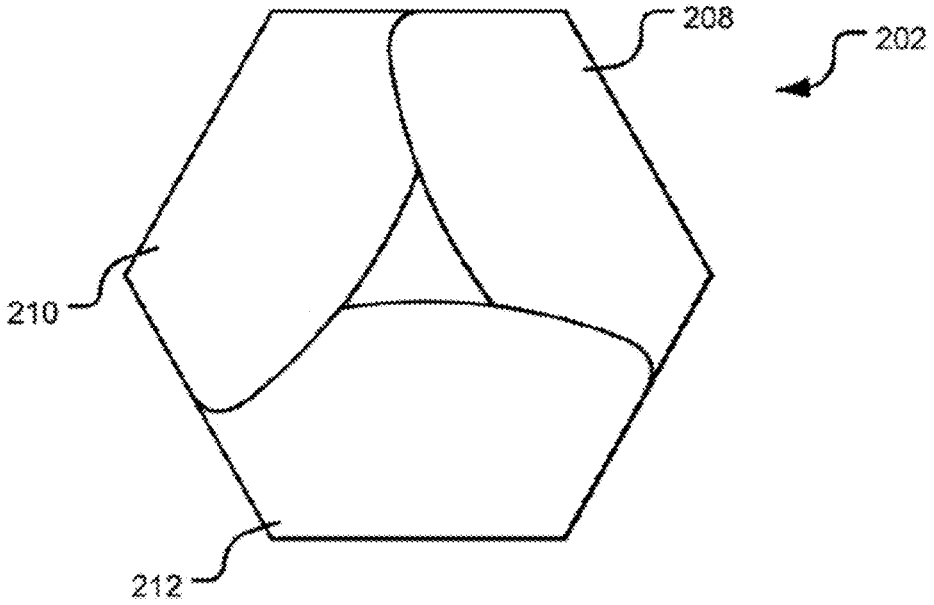

When fully closed, the flaps 206-212 lie over the storage disc 206, as illustrated in FIG. 2D. Similar to above, the flaps 208-212 at least partially cover a portion of the storage disc 206 and/or another of the flaps. For example, in the example shown in FIG. 2D, first flap 208 may be folded over the storage disc 206 first, followed by the third flap 212 such that the third flap partially overlaps with the first flap. The second flap 208 may be folded last to partially cover the storage disc 206, the third flap 212, and the first flap 208. However, the order in which the flaps 208-212 are folded over the storage disc 206 may vary each time the packaging 202 is closed. Also similar to above, the flaps 208-212 may be adhered to another flap to maintain the flaps closed over the storage disc 206, such as through an adhesive or slot and tab configuration. As shown in FIG. 2E, the enclosed packaging 202 may cover at least a portion of the storage disc 206 within the folded flaps 208-212. Further, the packaging 202, once closed, may have a hexagon shape.

In some instances, the lengths and angles of the fold lines of the hexagonal packaging 202 may be oriented such that the outer edge of the storage disc 206 touches a folded edge of the hexagon base. For example, as illustrated in FIG. 2D, the edge of the storage disc 206 may abut against fold 214 at point 252, abut against fold 232 at point 254, abut against fold 218 at point 256, abut against fold 226 at point 258, and abut against fold 216 at point 260. Thus, in this configuration, the hexagon shape of the packaging 202 holds the storage disc 206 may be held in place within the package at least through the six points of contact 250-260 created by the folds of the storage disc. The six points of contact 250-260 correspond to the six sides of the created hexagon shape. This may secure the storage disc 206 within the packaging 202 to prevent movement of the disc within the packaging that may result in damage to the disc.

Returning to FIG. 2A, the circular packaging 202 may also include one or more notches 240 in the outer edge of the packaging. In one implementation, the circular packaging 202 includes a notch 240 at one end of an angled fold line, such as angled fold line 224. In general, the notch 240 allows for easier tucking of corner 238 along the angled fold line 224 such that corner 242 may be folded inward toward the storage disc 206, thus bringing angled fold lines 222 and 224 into contact and inter-penetration, as shown in FIG. 2C. A similar notch may be located at the end of angled fold line 230 and angled fold line 236. In one implementation, each flap 208-212 may include a corresponding notch 240 to facilitate folding in of the corners 242-246. In other implementations, the circular packaging 202 may include more or fewer notches than illustrated in FIGS. 2A-2B.

Figure 3:
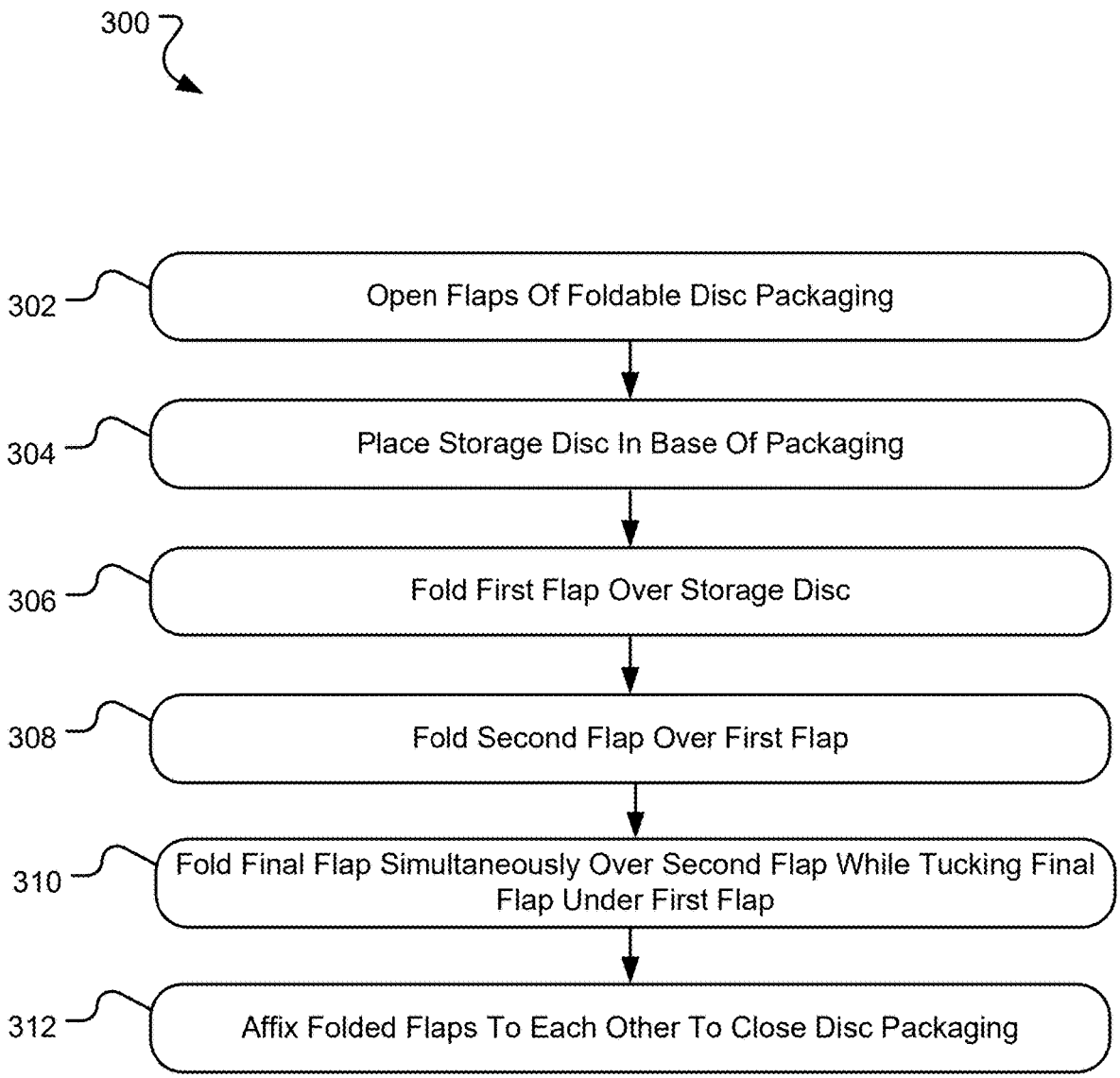
FIG. 3 is a method for enclosing a storage disc within a foldable packaging, according to aspects of the present disclosure.

FIG. 3 is a method 300 for enclosing a storage disc within a foldable packaging, according to aspects of the present disclosure. The method 300 may be executed with any embodiment of the circular, foldable packaging described herein. In some implementations, the operations of the method 300 may be executed by a packing robot or assembly line process to load the storage disc into the packaging. In general, the operations may be performed by any automated device or devices configured to load a storage disc into the foldable packaging.

At step 302, the foldable packaging 102, 202 may be opened to expose the base of the packaging. For example, the flaps 108-112 of the circular packaging 102 of the first embodiment 102 of FIGS. 1A-1B may be opened to make the triangular base 120 accessible. In another example, the flaps 208-212 of the circular packaging 202 of the embodiment of FIGS. 2A-2E may be opened to expose the hexagon base of the packaging. At step 304, the storage disc may be located on the base of the circular packaging, such as the triangular base or the hexagon base. In some instances, the storage disc 106, 206 may be located on the base such that the out edge of the storage disc abuts against a fold of the packaging when closed.

At step 306, a first flap of the packaging may be folded over the storage disc along a fold line, as described above. In general, any of the flaps of the packaging may be folded first over the storage disc. Following the folding of the first flap, a second flap may be folded over the first flap, at step 308. At step 310, the remaining flap may be simultaneously folded over the second flap while tucking the final flap under the first flap. This configuration of the flaps may hold each of the flaps closed over the storage disc. Further and as described above, one or more notches may be included on the flaps to aid in the tucking of the remaining flap under the first flap. At step 312, one or more of the folded flaps may be affixed in the closed position. In one implementation, one or more of the folded flaps may be adhered to the base of the packaging and/or another flap. In another implementation, the flaps may include a tab and slot configuration to affix each flap in place and secure the storage disc within the packaging.

Embodiments of the present disclosure include various steps, which are described in this specification. The steps may be performed by hardware components or may be embodied in machine-executable instructions, which may be used to cause a general-purpose or special-purpose processor programmed with the instructions to perform the steps. Alternatively, the steps may be performed by a combination of hardware, software and/or firmware.

Embodiments of the present disclosure include various operations, which also may be referred to as steps, which are described in this specification. The operations may be performed by or involve hardware components or may be embodied in machine-executable instructions, which may be used to cause a general-purpose or special-purpose processor programmed with the instructions to perform the operations. Alternatively, the operations may be performed by a combination of hardware, software and/or firmware.

Although various representative embodiments of this invention have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure.

While specific embodiments are discussed, it should be understood that this is done for illustration purposes only. A person skilled in the relevant art will recognize that other components and configurations may be used without parting from the spirit and scope of the disclosure. Thus, the above description and drawings are illustrative and are not to be construed as limiting. Numerous specific details are described to provide a thorough understanding of the disclosure. However, in certain instances, well-known or conventional details are not described in order to avoid obscuring the description.

Reference to "one embodiment" or "an embodiment" means that a particular feature, structure, or characteristic described in connection with the embodiment is included in at least one embodiment of the disclosure. The appearances of the phrase "in one embodiment", or similarly and synonymously "in one example" or "in one instance", in various places in the specification are not necessarily all referring to the same embodiment, nor are separate or alternative embodiments mutually exclusive of other embodiments. Moreover, various features are described which may be exhibited by some embodiments and not by others. The disclosure is not limited to various embodiments (examples, instances or aspects) given in this specification. Various modifications and additions can be made to the exemplary embodiments discussed without departing from the scope of the present invention. Accordingly, the scope of the present invention is intended to embrace all such alternatives, modifications, and variations together and in various possible combinations of various different features of different embodiments combined to form yet additional alternative embodiments, with all equivalents thereof.

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms are provided. A recital of one or more synonyms does not exclude the use of other synonyms. The use of examples anywhere in this specification including examples of any terms discussed herein is illustrative only and is not intended to further limit the scope and meaning of the disclosure or of any example term.

Without intent to limit the scope of the disclosure, examples of instruments, apparatus, methods and their related results according to the embodiments of the present disclosure are given. Note that titles or subtitles may be used in the various embodiments for convenience of a reader, which in no way should limit the scope of the disclosure.

Various features and advantages of the disclosure are set forth in the description above, and in part will be obvious from the description, or can be learned by practice of the herein disclosed principles. The features and advantages of the disclosure can be realized and obtained by means of the instruments and combinations particularly pointed out in the appended claims.

What is claimed is:

1. A package for a storage disc, the package comprising:

a flat, hexagonal base; and at least three foldable flaps extending from the hexagonal base to secure the storage disc within a folded hexagonal-shaped package, wherein each of the at least three foldable flaps corresponds to one of a plurality of fold lines along a portion of the hexagonal base defining an edge of the hexagonal base, wherein a first flap of the at least three foldable flaps is folded along a first fold line of the plurality of fold lines over the storage disc, a second flap of the at least three foldable flaps is folded along a second fold line of the plurality of fold lines over the first flap, and a third flap of the at least three foldable flaps is folded along a third fold line of the plurality of fold lines over the second flap, wherein the storage disc abuts the first fold line, the second fold line, and the third fold line at a midpoint of each of the plurality of fold lines to secure the storage disc within a folded, hexagonal-shaped package, the package forming a circular shape prior to folding into the folded hexagonal-shaped package.

2. The package for the storage disc of claim 1, wherein the hexagonal base is defined by the first fold line, the second fold line, the third fold line, a first bisecting fold line extending between the first fold line and the second fold line, a second bisecting fold line extending between the second fold line and the third fold line, and a third bisecting fold line extending between the third fold line and the first fold line.

3. The package for the storage disc of claim 2, wherein the storage disc abuts the first fold line, the second fold line, the third fold line, the first bisecting fold line, the second bisecting fold line, and the third bisecting fold line in at least six points of contact.

4. The package for the storage disc of claim 3, wherein the storage disc abuts the first bisecting fold line, the second bisecting fold line, and the third bisecting fold line at a midpoint of each of the bisecting fold lines to secure the storage disc within the folded, hexagonal-shaped package.

5. The package for the storage disc of claim 2 further comprising:

a first angled fold line extending from an intersecting point of the first fold line and the first bisecting fold line to an outer edge of the first flap; and a second angled fold line extending from an intersecting point of the first fold line and the third bisecting fold line to the outer edge of the first flap.

6. The package for the storage disc of claim 5 further comprising:

a third angled fold line extending from an intersecting point of the second fold line and the first bisecting fold line to an outer edge of the second flap; and a fourth angled fold line extending from an intersecting point of the second fold line and the second bisecting fold line to the outer edge of the second flap.

7. The package for the storage disc of claim 6 further comprising:

a fifth angled fold line extending from an intersecting point of the third fold line and the second bisecting fold line to an outer edge of the third flap; and a sixth angled fold line extending from an intersecting point of the third fold line and the third bisecting fold line to the outer edge of the third flap.

8. The package for the storage disc of claim 7 further comprising:

at least one notch along an outer edge of one of the at least three foldable flaps.

9. The package for the storage disc of claim 7, further comprising:

a first notch in the outer edge of the first flap, a second notch in the outer edge of the second flap, and a third notch in the outer edge of the third flap.

10. The package for the storage disc of claim 9, wherein the first notch is located at an intersecting point of the first angled fold line and the outer edge of the first flap.

11. The package for the storage disc of claim 9, wherein the second notch is located at an intersecting point of the fourth angled fold line and the outer edge of the second flap.

12. The package for the storage disc of claim 9, wherein the third notch is located at an intersecting point of the sixth angled fold line and the outer edge of the third flap.

13. The package for the storage disc of claim 1, wherein the second flap, when folded, is affixed to the first flap.

14. The package for the storage disc of claim 1, wherein the third flap, when folded, is affixed to the second flap.

15. The package for the storage disc of claim 1, wherein the storage disc is affixed to the hexagonal base prior to folding of the at least three foldable flaps.

* * * * *